US006709697B1

(12) United States Patent
Slife et al.

(10) Patent No.: US 6,709,697 B1
(45) Date of Patent: Mar. 23, 2004

(54) PROTECTIVE BARRIER COATING FOR SELECTIVE PAINT STRIPPING PROCESSES

(75) Inventors: Richard I. Slife, Warner Robins, GA (US); John Stropki, Westerville, OH (US); Rick Wolterman, Hilliard, OH (US); Robert E. Russell, III, Newark, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 10/271,095

(22) Filed: Oct. 15, 2002

(51) Int. Cl.[7] ..... B05D 1/36; B05D 3/12
(52) U.S. Cl. ..... 427/154; 427/407.1
(58) Field of Search ..... 427/154, 156, 427/407.1, 409, 410

(56) References Cited

U.S. PATENT DOCUMENTS 3,687,701 A * 8/1972 Reinhart, Jr. ..... 427/155
4,250,219 A * 2/1981 Pogoda ..... 428/212
4,274,887 A * 6/1981 Pogoda ..... 428/414
4,477,517 A * 10/1984 Rummel ..... 428/324
4,590,097 A * 5/1986 Booth et al. ..... 427/154
6,110,536 A * 8/2000 Harblin ..... 427/386
6,217,945 B1 * 4/2001 Fowler ..... 427/410
6,391,464 B1 * 5/2002 Harblin ..... 428/447
6,521,345 B1 * 2/2003 Lewin ..... 428/413

* cited by examiner

*Primary Examiner*—Bret Chen
*Assistant Examiner*—William Phillip Fletcher, III
(74) *Attorney, Agent, or Firm*—William G. Auton

(57) ABSTRACT

The concept of a barrier coating is applicable to any structure that requires repetitive paint removal. In principle, the coating is applied between a corrosion protective primer and protective topcoat for the purpose of encapsulating the corrosion resistant properties of the primer/surface treatment and allowing for a selective removal of the topcoat using acceptable mechanical coatings removal techniques. The 5-part coating system can be used on any type of structure that requires routine maintenance or repainting to preserve the integrity and/or appearance of the structure. Benefits associated with the concept of barrier coating include a significant reduction in the costs and manpower required to remove and reapply primer and topcoat systems from air- and land-based transportation vehicles, storage buildings, bridges and miscellaneous other structural applications. A second important benefit includes a reduction and/or elimination of the environmental hazards associated with (1) the treatment and disposal of primer and surface treatment residues (chromates, etc.), and (2) the release of toxic airborne pollutants during the precleaning, paint stripping, and painting operations conducted on large structures, thus limiting the exposure of workers.

4 Claims, 1 Drawing Sheet

PROTECTIVE BARRIER COATING FOR SELECTIVE PAINT STRIPPING PROCESSES

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to coatings and coatings removal and more specifically to a barrier coating applicable to aircraft and other structures where repetitive stripping and repainting is anticipated. Aircraft are generally painted with a primer, which can for example be based on an epoxy or urethane resin, and a topcoat, which is based on polyurethane. The subject coating system must resist water and certain organic solvents such as aviation fuel and hydraulic fluids based on phosphate esters such as tricresyl phosphate or tri-n-butyl phosphate. In addition, various coatings removal processes such as chemical, pressurized water and dry media blasting are utilized to remove the coating to the bare substrate. This involves a large amount of manpower, materials, and waste disposal and causes degradation to the substrate. The full coating removal and re-application process also represents a hazard to the environment and personnel.

A need remains for an improved barrier coating and selective paint stripping process that allows for the complete removal of the topcoat for structures where repetitive stripping is anticipated. One such example of this removal process is graffiti removal. The following U.S. Patents, which are incorporated herein by reference, give guidance for this application:

U.S. Pat. No. 5,970,993, Oct. 26, 1999, pulsed plasma jet paint removal, Witherspoon, F. Douglas, U.S. Pat. No. 4,590,097, May 20, 1986, Method of coating dual protective layers, Booth, Roger G., U.S. Pat. No. 5,773,091, Jun. 30, 1998, Anti-graffiti coatings and method of graffiti removal, Perlman, Daniel, U.S. Pat. No. 5,712,234, Jan. 27, 1998, Graffiti removers which comprise a dye bleaching agent, Pourreau, Daniel B., U.S. Pat. No. 5,030,290, Jul. 9, 1991, Paint stripping compositions and method of using same, Davis, Elbert, U.S. Pat. No. 4,231,805, Nov. 4, 1980, Vapor stripping process, Petterson, Robert, U.S. Pat. No. 4,231,804, Nov. 4, 1980, Vapor stripping method, Petterson, Robert.

"Blessings on all the kids who improve the signs in the subways . . . "

So begins Edward Field's 1963 poem "Graffiti," a sarcastic tribute to the artist-vandals who vanish with the daylight, but leave behind perverse, permanent reminders of their nocturnal antics. A well-known urban problem then, graffiti continues to plague our landscape. Public restrooms, schools, buses, subway cars, road signs, and bridges are just a few of the prime targets for the vandals.

In addition to a painting and paint stripping of aircraft, a need remains to remove graffiti paint, permanent ink and other coatings embedded in structural materials such as concrete block, limestone, metal and wood. Black provides a background to the graffiti problem, and complications involved in removing graffiti from painted and unpainted surfaces in the prior patent as follows:

In attempting to cope with the graffiti problem, much emphasis has been placed on cleaning techniques for use in treating surfaces to remove graffiti. A common technique is to apply a coating of paint remover, such as methylene chloride, benzene or toluene. The paint remover is applied, allowed to dwell on the material for a predetermined period, and then removed by a pressurized water washer. This process may be repeated two to four times to remove as much graffiti as possible. Any graffiti residue is then removed by sandblasting or sanding, which may require a refinishing of the surface to restore it to its former appearance. A second technique for coping with graffiti is to simply repaint the surface, which is timely, expensive, adds weight to the structure and makes the coating system more brittle. The use of a chemical paint remover also has the disadvantage of releasing harmful vapors to the environment and that are detrimental to the health of the workers. In addition, chemical paint strippers tend to soften and remove the underlying paint.

Specialized cleaning compositions have been developed for removing graffiti. Examples of such cleaning compositions are disclosed in U.S. Pat. No. 5,024,780 to Leys. These cleaning compositions are designed for graffiti removal and not as anti-graffiti coatings. The intent of this patent is to introduce a barrier coating and selective coating removal process that will safely remove any surface coating leaving the barrier and primer intact and thus protecting the substrate.

As was mentioned in the previous text, aircraft structures are generally painted with an epoxy or urethane-based primer, and a protective polyurethane topcoat. The entire coating system must be capable of resisting water and certain organic solvents that are used to remove aviation fuel and hydraulic fluids that are based on phosphate esters such as tricresyl phosphate or tri-n-butyl phosphate.

In addition to the conventional two coats of paint, prior art discloses an invention by Booth (U.S. Pat. No. #4,590,097) that describes a solvent-resistant barrier coating that is used beneath commercial aerospace polyurethane topcoat systems. The barrier coating comprises a film-forming addition of a polymer comprising units of a vinyl aromatic monomer and units of a monomer containing a hydroxyl alkyl group and a polyisocyantate containing at least two isocyanate groups per molecule. The addition polymer has hydroxyl content in the range 0.5 to 5 percent by weight due to the presence of the hydroxyl alkyl groups and preferably contains at least 30 percent by weight of the vinyl aromatic monomer. The ratio of isocyanate groups to hydroxyl groups is in the range 1:1 to 2:1. It has been demonstrated that the polyurethane topcoat can be selectively removed from the substrate through the use of a stripping solvent such a methylene chloride. For the subject process, the barrier coating remains undamaged on the surface of the coated parts.

The Booth invention relates to a coating composition that produces a protective coating that is resistant to organic stripping solvents such as methylene chloride. Claims within the invention describe a method for coating a primer coated substrate with a "barrier" coating that is then over-coated with a coating that can be easily stripped off by using commercial organic solvents. The subject coating compositions are particularly useful for coating aircraft structures.

Both Booth, and the present invention introduce the intermediate barrier coat concept as a means of providing a coating composition that is used below a polyurethane topcoat. For example, this intermediate barrier coating is applied between the primer and topcoat, and designed to resist different paint stripping processes that are commonly used to remove polyurethane coatings from aircraft structures. This intermediate barrier coating encapsulates the hazardous materials beneath it by providing protection to the primer coating during the referenced paint removal processes. This encapsulation process, and a subsequent elimination of primer coating removal eliminates the need to wash, etch, alodine and primer coat the stripped surfaces of metallic aircraft structures, which significantly reduces the amount of hazardous waste generated during the paint stripping and re-paint processes.

One specific type of intermediate coating that is disclosed in British Patent No. 1511935 is referenced as a non-cross-linked polyamide. This material is at least partially resistant to the solvents used to remove the topcoat; however, it is designed to be easily removed from the primer coating by using alcohol-based solvents. One opinion suggests that many aircraft systems engineers and maintenance facilities would prefer to use an intermediate barrier coat that is more highly insoluble with the primer coatings. This feature would ensure minimal contact between the solvents and the protective primer coating. An additional requirement for the referenced British intermediate coating is improved adhesion between the intermediate coat and the topcoat.

Polyurethane topcoats for aircraft are generally derived from hydroxyl-functional polyester and a polyisocyanate. British Patent No. 1252402, U.S. Pat. No. 3,558,564, and European Patent Application No. 29598 each describe coatings based on hydroxyl-functional acrylic polymers that are reacted with polyisocyanates for use as finishes on cars, trucks, aircraft, and railway equipment.

In a process according to the cited inventions for providing a substrate with a strippable polyurethane coating (1) derived from a hydroxyl-functional polyester and a polyisocyanate, a barrier coating (2) comprising:

(a) a film-forming addition polymer comprising units of a vinyl aromatic monomer and units of a monomer containing a hydroxyl alkyl group in an amount sufficient to provide a hydroxyl content for the addition polymer in the range 0.5 to 5 percent by weight, and (b) a polyisocyanate containing at least two isocyanate groups per molecules applied to the substrate at a ratio of isocyanate groups in (b) to hydroxyl groups in (a) of 1:1 to 2:1 before the polyurethane coating (1) so that the polyurethane coating (1) can be removed from the substrate by a stripping solvent without removing the barrier coating (2). The Booth invention of U.S. Pat. No. 4,590,097 includes a coating system comprising a primer to be applied as a coat contacting the substrate and a polyurethane coating (1) derived from a hydroxyl functional polyester and a polyisocyanate to be applied as the topcoat, characterized by the use, as an intermediate coating between the primer and the topcoat, of a barrier coating (2) as defined above.

There are structures, such as military aircraft, where repetitive stripping and repainting is anticipated. Accordingly, a need exists for military and commercial paint and depaint strategies. Possible depaint strategies include dry media blasting, pressurized water technologies, and the use of environmentally safe chemical strippers. One such paint strategy drafted by the United States Air Force hopes to achieve a permanent coating system which will eliminate any use of hazardous chemicals and associated chemical processes for aircraft maintenance. Various coatings were tested as a candidate barrier coating and a single epoxy-siloxane based coating (U.S. Pat. No. 5,275,645) was chosen as a potential candidate. Numerous modifications to the subject coating were completed to achieve the desired barrier coating performance properties. This barrier coating was selected because the coating system performs within the requirements of applicable Air Force military specifications when used with Air Force approved epoxy/urethane primers, and polyurethane topcoat. These primers and topcoats were selected for use with a modified version of the Epoxy-Polysiloxane-barrier coating because of their current use on military aircraft, and a resultant minimal impact to production schedules and existing aircraft coating system performance requirements.

The above-cited barrier-coating concept has the potential of alleviating the requirement for stripping to substrate, the reapplication of the substrate surface preparation (i.e. wash, etch, alodine, etc.), and the reapplication of the primer, thus encapsulating the corrosion protective systems under the barrier coating. Placing the barrier coating between the polyurethane topcoat and primer surface preparation undercoating and when used with a specifically designed dry media blasting and/or pressurized water stripping allows topcoat removal only. Removing the topcoat only, eliminates the use of hazardous chemicals for the paint stripping process by encapsulating all the hazardous materials from the surface preparation and primer. Thus reducing the total hazardous waste disposal from the paint and paint removal processes.

SUMMARY OF THE INVENTION

The present invention is described as a protective barrier coating that is designed for use on structures where repetitive stripping and repainting is anticipated. The total combination of this protective barrier-coating scheme includes a surface preparation and primer coating that is applied to a properly cleaned structure, a barrier coating that is applied to the primer, and then a polyurethane topcoat that is applied to the barrier coating. The topcoat provides UV and rain-erosion resistance until degraded, and is then selectively removed from the barrier coating with an approved coating removal process.

In one embodiment of the invention, the primer can be one such as an epoxy or urethane-based primer and a polyurethane topcoat, where the improvement is in the design of the barrier coating that is applied between these materials. Improvements include an optimization of the application intervals used for the separate coatings, pre-application processing of the barrier coating, as well as the resin-to-cure ratios required to properly blend the barrier coating.

One embodiment of the present invention involves a physical and chemical modification of an existing Epoxy-Polysiloxane coating. After a careful down selection of numerous commercial and experimental coatings, Engineers conducted an extensive amount of laboratory and strippability testing on the Epoxy-Polysiloxane coating with several resin-to-cure ratios ranging from 6:1 to 1:1 by volume, under a controlled set of application conditions. Testing concluded that the most acceptable properties to obtain maximum performance were available with the Epoxy-Polysiloxane coating after a mechanical grinding of the coarse pigment particles, a modification to the resin to cure ratio, and a controlled application of the topcoat to the barrier coating. Specifically, the existing course version of the Epoxy-Polysiloxane coating must be ball milled to a Hegman 6.0 to 7.5 microns, admixed with a specific resin to cure ratio within the range of 6:1 to 1:1 by volume, and topcoated under a controlled set of application conditions within a period of 2 to 5 hours for improved system weatherability. The carefully controlled milling process, specified resin to cure ratio and controlled application conditions provide the optimum performance properties for a barrier coating. The optimum properties of a barrier coating include improvements in the weatherability of the topcoat, selective removal of the topcoat with minimal damage to subject barrier coating, and an encapsulation of the surface preparation/primer, which eliminate virtually all the hazardous waste associated with the corrosion protective system.

A mechanically ground version of the Epoxy-Polysiloxane barrier coating in a'specified resin to cure ratio, after application to either epoxy or urethane based primers over a chemically cleaned and pretreated surface, is then coated with a polyurethane topcoat. This complete four-part coating system is capable of meeting current requirements for the application, performance, and maintenance of military and commercial coatings. Typical performance requirements that were qualified for the disclosed barrier coating system include: corrosion, adhesion, wear, abrasion resistance, rain erosion resistance, impact resistance, flexibility, and selective strippability.

The present invention may be defined as a five-step process for providing a substrate with a topcoat that is selectively removable with dry media blast and/or pressurized water processes specifically designed for this barrier coating system. The first step of the process is to chemically pretreat the surface for maximum adhesion to the primer. The second step of the process is performed by applying a corrosion resistant primer of either epoxy or urethane composition to the substrate. The third step of the process is performed by covering the primer coating with a modified version of the Epoxy-Polysiloxane barrier coating at the specified resin to cure ratio to protectively seal the corrosion protection properties of the primer during routine paint stripping operations. The fourth step of the process involves a controlled application of a polyurethane topcoat or Fluropolymer modified urethane topcoat to the barrier coating. The final step of the process involves selectively stripping the topcoat using either a dry media blast or pressurized water process, a controlled re-activation of the barrier coating and reapplication of new topcoat.

This invention includes the selection and development of a barrier coating that is applied at an optimized Dry Film Thickness (DFT) between corrosion resistant primers and a polyurethane topcoat or Fluropolymer modified urethane topcoat. The coating is designed to provide excellent adhesion to either an epoxy or urethane primer, and also provide adequate adhesion to polyurethane or Fluropolymer modified urethane topcoat systems. The topcoat-to-barrier adhesive bonds are carefully controlled to permit (1) a quick removal of the topcoat during depaint/repaint operations, (2) adequate adhesion for operational conditions, (3) a minimal amount of barrier coating damage from the dry media blast or pressurized water paint stripping techniques, (4) Encapsulation of the hazardous materials contained within the surface pretreatment and/or primer systems, and (5) . . . 5) Improvements in the weathering of the polyurethane topcoat to include UV, color retention, and gloss retention.

DESCRIPTION OF THE DRAWINGS

The sole figure of the drawings is FIG. 1, which is a cross-sectional view of the three-part coating system being disclosed in the present invention.

DETAILED DESCRIPTION OF THE PREFERRED EMBODIMENT

Figure 1:
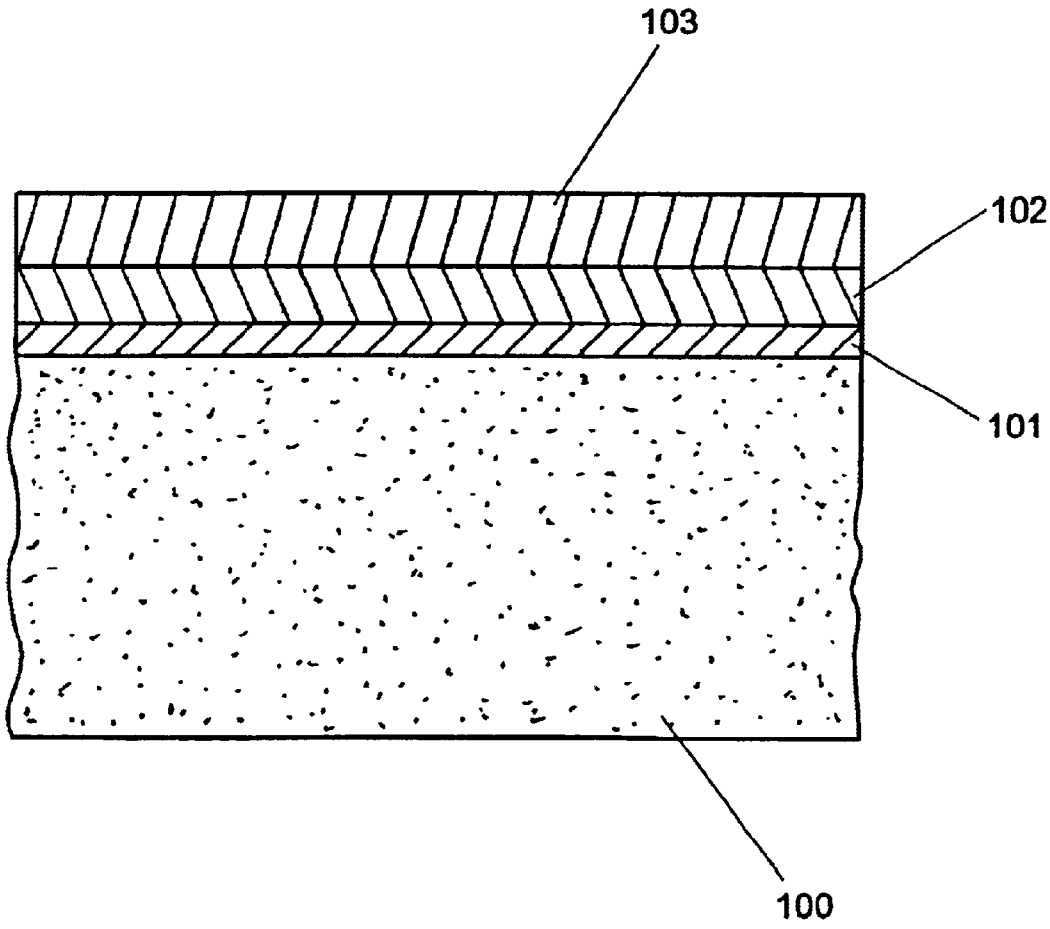

The present invention describes a protective barrier coating that is designed for use on structures where repetitive paint stripping and repainting is anticipated. The reader's attention is now directed towards FIG. 1, which illustrates an embodiment of the invention. As shown in FIG. 1, this embodiment has the substrate 100 with a surface treatment 101, coated with a corrosion-resistant primer of either an epoxy or urethane composition; a barrier coating 102; and a protective polyurethane or Fluropolymer modified urethane topcoat 103. Extensive testing has shown an optimum combination of the coating system as a result of a physical and chemical modification of an Epoxy-Polysiloxane coating has application as a barrier coating. Coating system performance (i.e., weatherability, cleanability, strippability and corrosion resistance) is also optimized as a result of the application time(s) of the barrier coating to primer, and topcoat to barrier coating.

Preliminary screening tests were conducted on numerous commercial and experimental coatings. A test selection process was then conducted to identify a single barrier coating for application on metallic and composite aircraft structures. A primary criterion for coating selection was minimal damage after a selective removal of the polyurethane topcoat with pressurized water or dry media blast coating removal process. A secondary criterion was to encapsulate all the hazardous materials in the surface pretreatment and primer systems.

Under the direction of Air Force, engineers conducted an extensive amount of laboratory and strippability testing on the modified Epoxy-Polysiloxane coating. This testing concluded that the most acceptable performance properties for barrier coating application are available with the Epoxy-Polysiloxane coating after a mechanical grinding of the coarse pigment particles is completed and then applied at the specified resin to cure ratio. Specifically, the commercially available coarse version of the coating must be ball milled to a Hegman 6.0 to 7.5 sizes prior to application on protective primers. This carefully controlled milling process serves to reduce the larger sized pigmentation particles in the coating and applying it at a specific resin to cure ratio influences the chemical and physical properties of the coating for optimum barrier coating applications.

A mechanically ground version of the Epoxy-Polysiloxane barrier coating after specified resin to cure ratio application to either epoxy or urethane based primers and then coated with a protective urethane topcoat is capable of meeting current requirements for application, performance, and maintenance. Typical performance requirements include: corrosion, adhesion, wear, impact resistance, and flexibility. In addition, increased topcoat performance is obtained along with selective removal of the topcoat and encapsulation of the hazardous materials in the surface pretreatment and primer systems.

The total combination of this paint system has a surface pretreatment, primer coating that goes on a structure surface, a minimum of a 2-mil barrier coating on top of the primer, and a polyurethane topcoat that is selectively removed by either a dry media blast or pressurized water process.

The scope of this invention was twofold. First, to identify and/or develop a barrier coating that is capable of protecting corrosion inhibited surface treatments and primers from damage when using a mechanical paint stripping process to remove the polyurethane topcoat Second, to demonstrate and validate that a pressurized water or dry media blast coatings removal process is capable of consistently and efficiently removing only the topcoat from the protective barrier coating. The selective striping process should produce minimal erosion damage to the barrier coating and encapsulate the hazardous materials underneath. Additionally, the entire coating system must be completely removable from substrates materials with military or commercially available paint removal processes.

One of the major challenges posed by the investigation of a selective stripping process is a preservation of the integrity of the barrier coating, primer coating and surface pretreatment. Specifically, the pressurized water or dry media selective stripping process must not compromise the corrosion resistance afforded by corrosion resistant primers and surface treatment applied to the structures. Maximum protection to the primer coating is assured by minimizing any erosion-related damage to the barrier coating.

The present invention may be defined as a five-step process for providing a substrate with a strippable topcoat coating. Pretreating the substrate to clean and chemically treat the surface for maximum corrosion protection and adhesion performs the first step of the process. The second step is to apply a corrosion protective primer of epoxy or urethane. Covering the primer coating with a modified Epoxy-Polysiloxane barrier coating at a 30 to 70% by volume resin to cure ratio performs the third step of this process. That protects the said primer coating and encapsulates the hazardous materials in said primer along with eliminating the need for future hazardous surface treatments and reapplications of said primer. The fourth step of the process involves applying a polyurethane topcoat to the barrier coating. The final step of the process involves using a non-chemical abrasive stripping process such as pressurized water or dry media blasting that has been refined to remove the topcoat with minimal damage to the barrier coating.

It must be emphasized that one of the goals of the invention was to allow polyurethane and Fluropolymer modified urethane topcoats to be stripped, not by chemical solvents, but by medium pressure water or dry media blast stripping. The selective paint stripping trials conducted were performed on laboratory test panels and on an F-15 aircraft after 15 months of service.

The development of the present invention included tests that concentrated on developing possible correlations among the preparation, application and aging of a barrier coating to both epoxy-or urethane-based primers with the performance of the total coating system. Specifically, all efforts focused on determining how the barrier coating can be prepared and applied to the primer-coated surfaces of both metallic and composite materials to ensure maximum operational performance such as in-flight on an aircraft.

While the invention has been described in its presently preferred embodiment it is understood that the words, which have been used, are words of description rather than words of limitation and that changes within the purview of the appended claims may be made without departing from the scope and spirit of the invention in its broader aspects.

What is claimed is:

1. A process for providing a substrate with a strippable topcoat by encapsulating a surface treatment and a primer, the process comprising the steps of:

treating the surface of the substrate for maximum corrosion protection and adhesion;

covering the substrate with a corrosion protective primer of epoxy or urethane;

covering the primer coating with a physically and chemically modified epoxy-polysiloxane barrier coating that protects the primer; and applying either a polyurethane or fluoropolymer-modified urethane topcoat to the barrier coating that can be stripped from said barrier coating with refined pressurized water stripping or dry media blast process.

2. A process, as defined in claim 1, wherein said barrier coating has a thickness of at least 2 mils.

3. A process, as defined in claim 2, wherein said epoxy-polysiloxane barrier coating comprises mechanically ground pigment particles.

4. A process, as defined in claim 2, wherein said epoxy-polysiloxane barrier coating is applied using a specific resin to cure ratio that is within the range of 6:1 to 1:1 by volume.

* * * * *